US008474923B2

(12) United States Patent
Pendleton

(10) Patent No.: US 8,474,923 B2
(45) Date of Patent: Jul. 2, 2013

(54) SAFES WITH ROTATING INNER SUPPORTS

(75) Inventor: Bruce Pendleton, Loganville, GA (US)

(73) Assignee: Pendleton Safe Company, Loganville, GA (US)

( * ) Notice: Subject to any disclaimer, the term of this patent is extended or adjusted under 35 U.S.C. 154(b) by 448 days.

(21) Appl. No.: 12/054,091

(22) Filed: Mar. 24, 2008

(65) Prior Publication Data

US 2008/0229983 A1 Sep. 25, 2008

Related U.S. Application Data

(60) Provisional application No. 60/896,365, filed on Mar. 22, 2007.

(51) Int. Cl.
*A47B 95/00* (2006.01)
*E05G 1/00* (2006.01)

(52) U.S. Cl.
USPC ..... 312/305; 109/48

(58) Field of Classification Search
USPC ..... 312/125, 135, 305, 409, 281, 97.1, 312/138.1, 280; 108/139, 141, 142, 94–96, 108/22, 103, 105; 109/48, 70; 206/317
See application file for complete search history.

(56) References Cited

U.S. PATENT DOCUMENTS

| | | | | |
|---|---|---|---|---|
| 195,219 | A | 9/1877 | Kingham | |
| D16,806 | S | 7/1886 | Farrel | |
| 353,382 | A * | 11/1886 | Schmidt | 312/249.2 |
| 492,304 | A | 2/1893 | Markle | |
| D36,919 | S | 5/1904 | Brinton | |
| 941,940 | A | 11/1909 | McCormick | |
| 1,551,879 | A * | 9/1925 | Hoffman | 62/125 |
| 1,736,007 | A * | 11/1929 | Johnston | 312/305 |
| 1,759,129 | A | 5/1930 | McClintock et al. | |
| 2,024,330 | A * | 12/1935 | Bemis | 248/158 |
| 2,078,813 | A * | 4/1937 | Sarullo et al. | 312/125 |
| 2,081,271 | A | 5/1937 | Ellithorpe | |
| 2,153,682 | A * | 4/1939 | Vicek | 312/305 |
| 2,158,623 | A * | 5/1939 | Fischbacher | 312/6 |
| 2,610,473 | A * | 9/1952 | Chovanec | 62/250 |
| 2,624,650 | A | 1/1953 | De Perales | |
| D175,470 | S | 8/1955 | Kahn | |
| 3,762,789 | A | 10/1973 | Robertson | |
| 3,927,923 | A | 12/1975 | Kimmel | |
| 4,099,808 | A | 7/1978 | Oakley et al. | |
| D252,430 | S | 7/1979 | Oakley et al. | |
| 4,244,302 | A | 1/1981 | Stine | |
| D260,710 | S | 9/1981 | Miller | |
| 4,848,856 | A * | 7/1989 | Dyment et al. | 312/135 |
| D335,595 | S * | 5/1993 | Bowen | D6/472 |
| D348,576 | S | 7/1994 | Narramore | |
| D408,174 | S | 4/1999 | Aspenwall | |
| D462,517 | S | 9/2002 | Knox et al. | |
| 6,865,993 | B2 | 3/2005 | Bartel et al. | |
| 6,868,975 | B2 | 3/2005 | Sells et al. | |
| 7,043,946 | B2 | 5/2006 | Cline | |
| 7,096,801 | B2 | 8/2006 | Bartel et al. | |
| D586,525 | S * | 2/2009 | Pendleton | D99/28 |

(Continued)

*Primary Examiner* — Janet M Wilkens
(74) *Attorney, Agent, or Firm* — Brient Intellectual Property Law, LLC

(57) ABSTRACT

Gun safes according to various embodiments include a secure housing and a rotatable gun support assembly that is disposed at least partially within an interior portion of the secure housing, and that is adapted to support rifles in a substantially upright position adjacent a perimeter of a portion of the gun support assembly.

16 Claims, 7 Drawing Sheets

U.S. PATENT DOCUMENTS

| | | | | |
|---|---|---|---|---|
| D598,175 | S * | 8/2009 | Pendleton | D99/28 |
| 8,393,280 | B2 * | 3/2013 | Bartel | 109/48 |
| 2003/0141794 | A1 | 7/2003 | Cleveland et al. | |
| 2004/0045914 | A1 | 3/2004 | Sells et al. | |
| 2004/0140235 | A1 * | 7/2004 | Cleveland et al. | 206/315.11 |
| 2006/0283361 | A1 | 12/2006 | Bartel et al. | |
| 2011/0174199 | A1 * | 7/2011 | Pendleton et al. | 109/59 R |

* cited by examiner

SAFES WITH ROTATING INNER SUPPORTS

CROSS-REFERENCE TO RELATED APPLICATIONS

This application claims priority from U.S. Provisional Application No. 60/896,365, filed Mar. 22, 2007, the contents of which are hereby incorporated by reference in their entirety.

BACKGROUND OF THE INVENTION

Current gun safes are typically in the form of a metal, upright, rectangular box that includes a rectangular door at the front of the box. One disadvantage of such gun safes is that they are not well suited for the storage and management of large numbers of firearms. For example, a user storing 40 rifles in a particular rectangular gun safe may have to remove 20 or more of the rifles in order to access a particular rifle at the back of the safe. This can be inconvenient and time consuming, especially because most gun safes do not include a light for viewing guns stored in the rear interior portion of the safe.

Also, to conserve space, most current gun safes are stored in the corner of a room. Due to the rectangular box structure of these gun safes and the structure and orientation of the gun safe's doors, this often results in the door forming an angle of less than 90 degrees with the gun safe's access opening when the door is opened. This can limit access to the gun safe's interior.

SUMMARY OF VARIOUS EMBODIMENTS OF THE INVENTION

Generally speaking, gun safes according to various embodiments of the invention include a rotatable interior gun support assembly that is adapted to support rifles in at least a substantially upright position (or other suitable orientation) adjacent a perimeter of a portion of the gun support assembly. For example, in particular embodiments, the interior gun support assembly includes a substantially circular, substantially horizontal, rotatable gun barrel support member that is adapted to support rifles in at least a substantially upright position adjacent the outside perimeter of the gun barrel support member. In various embodiments, the gun support assembly includes: (A) a gun support portion that is disposed within the gun safe's secure housing; and (B) an upper shelf that is disposed: (1) outside of the interior of said the housing; and (2) adjacent an upper surface of the secure housing. In particular embodiments, this upper shelf is mounted to rotate in tandem with one or more portions of the gun support portion. In various embodiments, the gun safe includes a motor for rotating the gun support assembly at least substantially without manual assistance from a user.

In particular embodiments, to remove a particular rifle from the gun safe, the user: (1) opens a secure door that selectively controls access to the interior of the gun safe; (2) rotates the gun support assembly until the desired rifle is in front of the door's access opening; and (3) removes the desired rifle from the gun safe through the door's access opening. In particular embodiments of the invention, the exterior housing of the gun safe is substantially in the form of an upright cylinder.

In various embodiments, the gun support assembly may be used to support and store rifles, small firearms such as pistols, or other items.

BRIEF DESCRIPTION OF THE DRAWINGS

Figure 1:
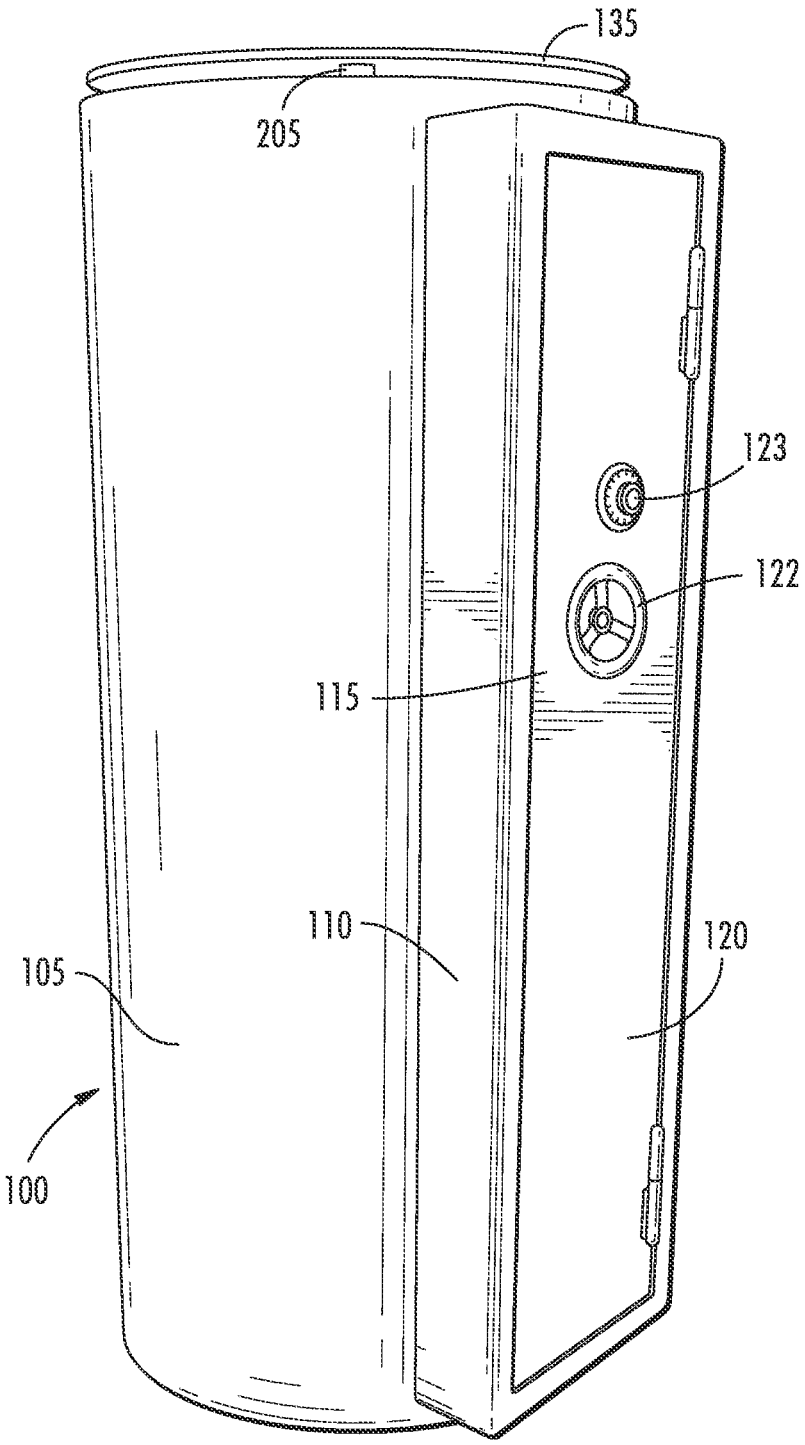

Having thus described various embodiments of the invention in general terms, reference will now be made to the accompanying drawings, which are not necessarily drawn to scale, and wherein:

FIG. 1 is a perspective view of a gun safe according to a particular embodiment of the invention. In this figure, the gun safe's access door is shown closed.

Figure 2:
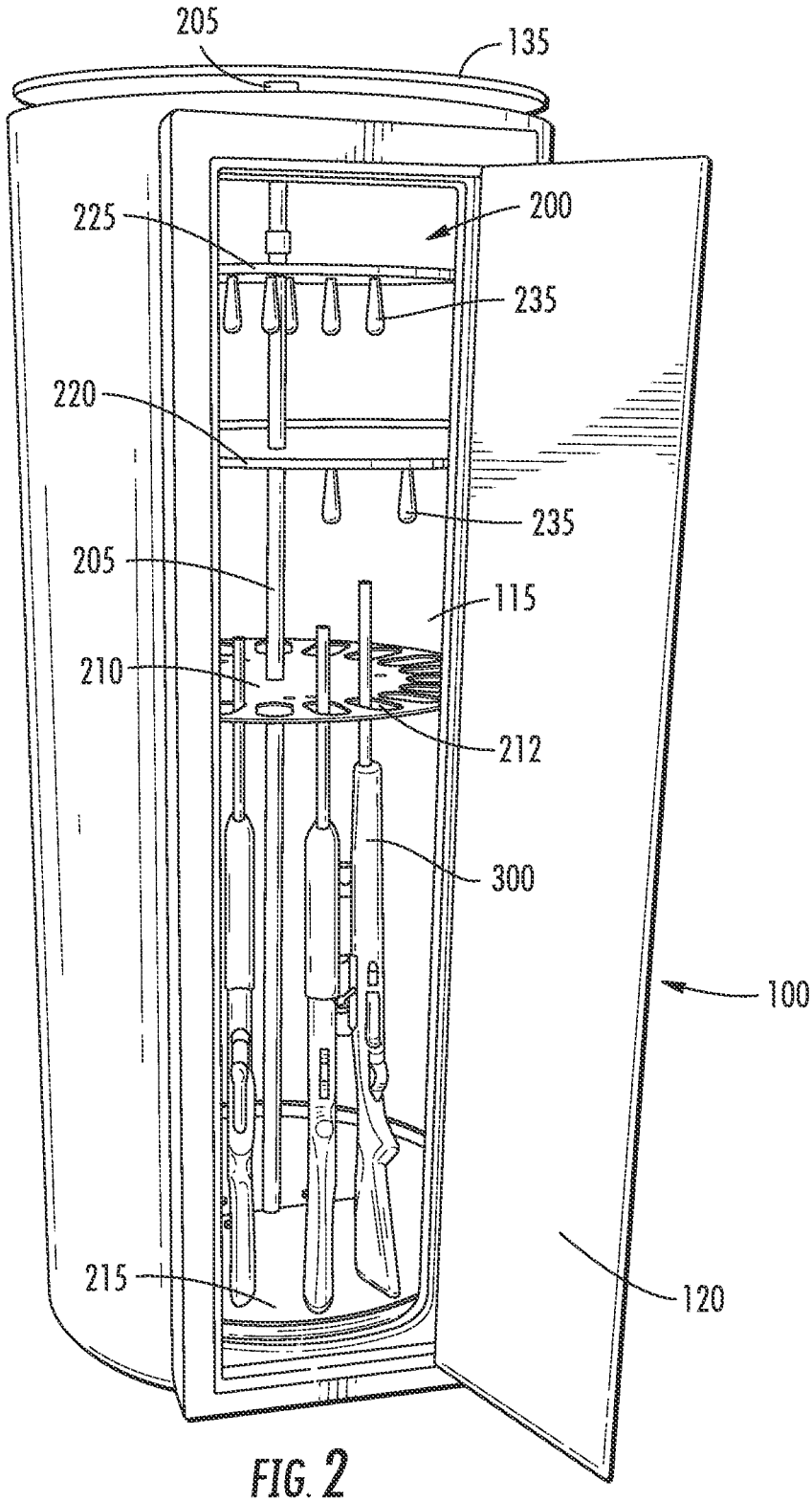

FIG. 2 is a perspective front view of the gun safe of FIG. 1. In this figure, the gun safe's access door is shown open.

Figure 3:
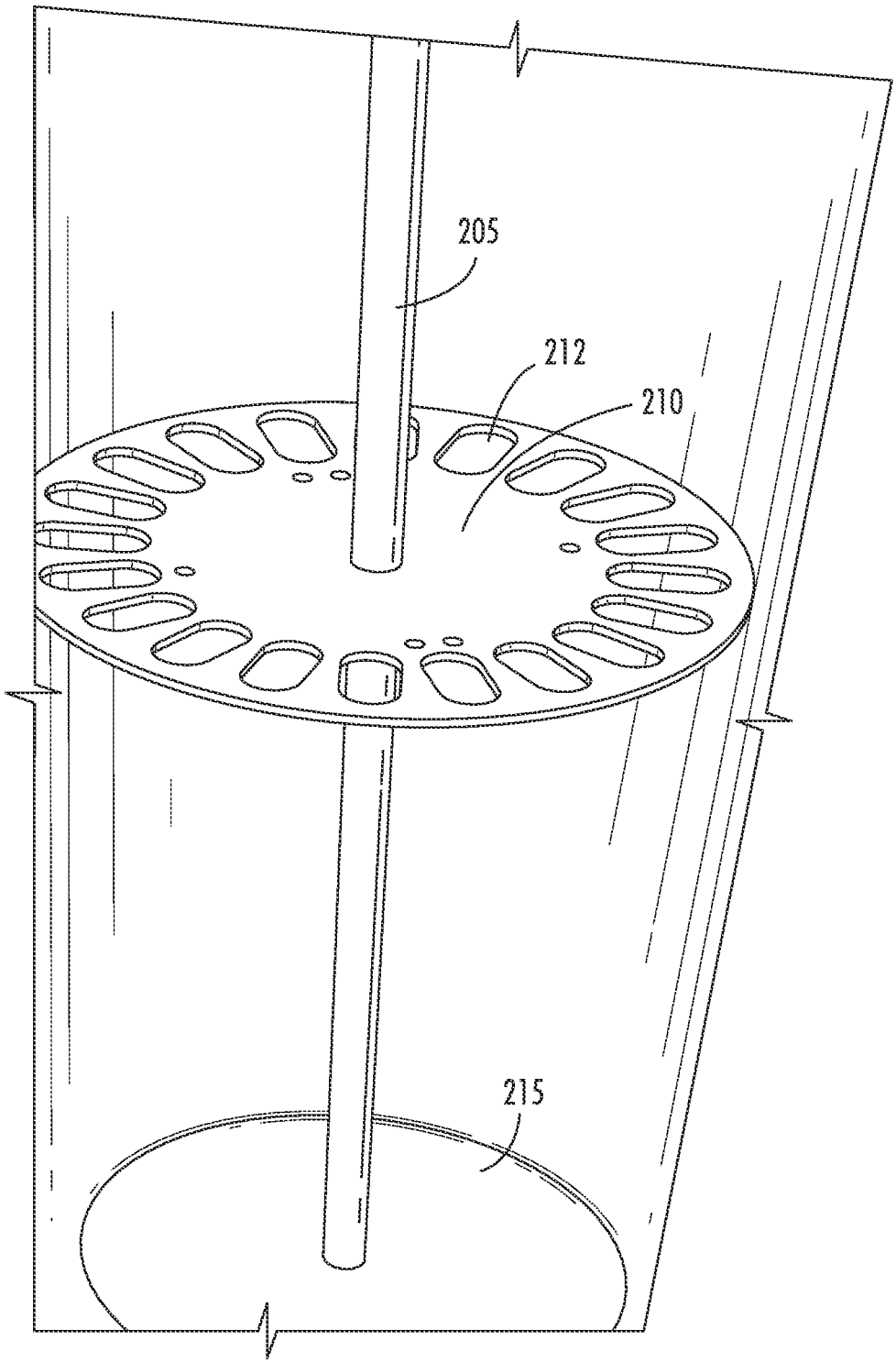
Figure 4:
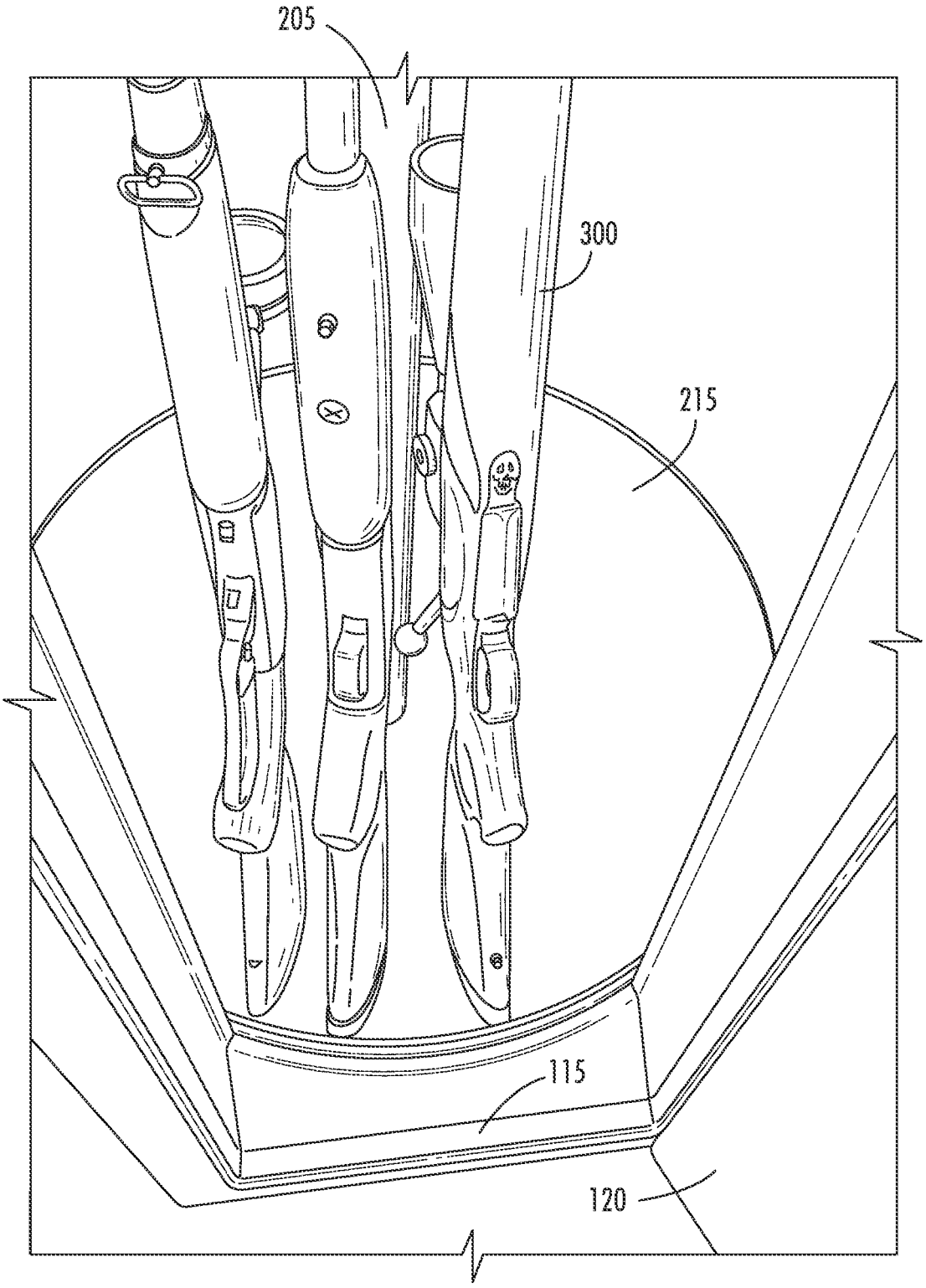

FIGS. 3 and 4 are perspective, close-up views of portions of the gun support assembly shown in FIG. 1.

FIG. 4 is a perspective view of a gun safe according to a particular embodiment of the invention.

Figure 5:
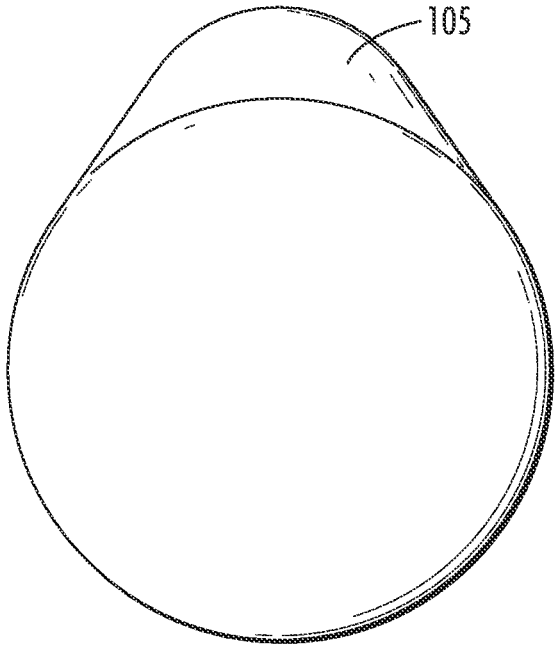

FIG. 5 is a perspective bottom view of an exemplary gun safe's housing.

Figure 6A:
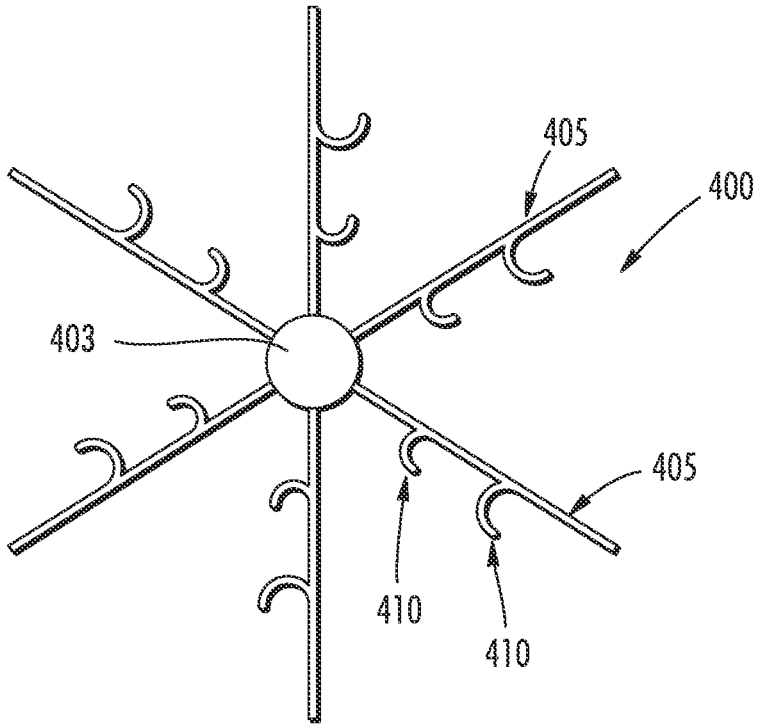

FIG. 6A is a top, plan view of a gun barrel support assembly according to an alternative embodiment of the invention.

Figure 6B:
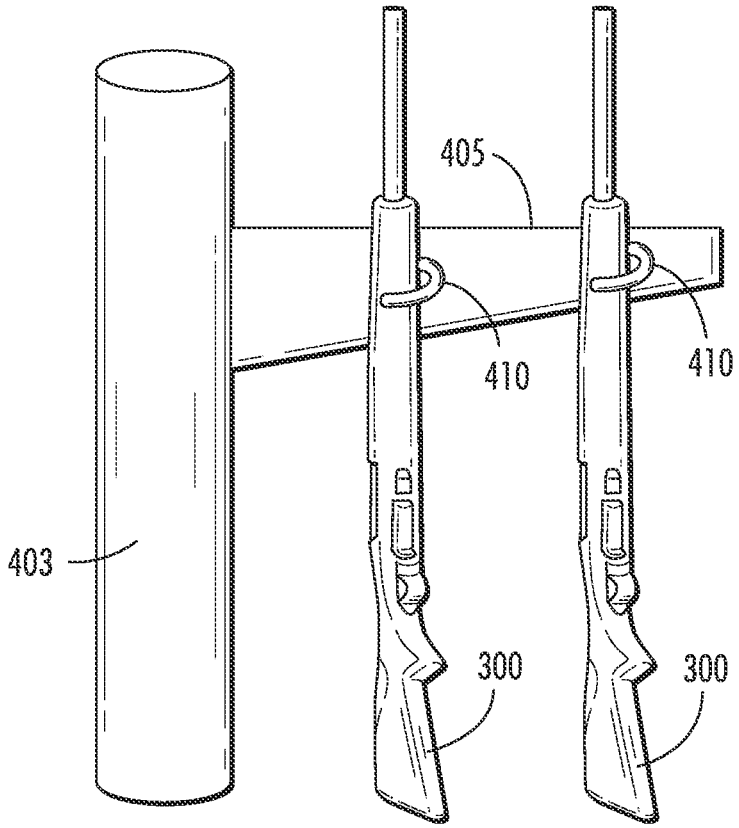

FIG. 6B is a side view of the gun barrel support assembly of FIG. 6A showing an exemplary barrel support member.

DETAILED DESCRIPTION OF VARIOUS EMBODIMENTS OF THE INVENTION

Various embodiments of the present invention will now be described more fully hereinafter with reference to the accompanying drawings, in which various embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Structure of Exemplary Gun Safe

As shown in FIGS. 1-5, a gun safe 100 according to a particular embodiment of the invention comprises a substantially cylindrical outer housing 105 that defines a thin, elongate, upright, rectangular access passage 110 that extends radially outwardly from an outer side portion of the substantially cylindrical outer housing 105. A thin rectangular access door 120 is mounted at the outer end of this access passage 110.

The outer housing 105 defines an interior portion that is dimensioned for storing a plurality of rifles 300, and the access door 120 is adapted to selectively restrict access to this interior portion. In particular embodiments, the access door includes a lock 123 (e.g., a combination lock) that is adapted for selectively maintaining the access door 120 in a closed and locked orientation in which the access door 120 prevents access to the outer housing's interior portion.

As shown in FIGS. 2-4, in various embodiments, the gun safe 100 includes a rotatable interior gun support assembly 200 that is adapted to support rifles 300 in an upright position adjacent a perimeter of a portion of the gun support assembly 200. For example, in particular embodiments, the gun support assembly 200 includes a substantially circular, substantially horizontal, rotatable gun barrel support member 210 that is adapted to support rifles 300 in at least a substantially upright position adjacent its outside perimeter, as shown in FIG. 2.

In particular embodiments, the gun support assembly 200 includes a central, vertical shaft 205 that extends substantially through a center portion of the gun support assembly 200. This shaft 205 is preferably rotatably mounted on bearings (not shown) at the top and bottom of the shaft 205. In particular embodiments, these bearings are attached, respectively, approximately adjacent the center of the ceiling and floor of the gun safe 100.

In various embodiments, the barrel support member 210 is mounted adjacent (e.g., on) the central shaft 205 so that the central shaft 205 extends through substantially the center of the barrel support member 210. Accordingly, in particular embodiments, the barrel support member 210 may rotate in a substantially symmetrical manner about the central axis of the central shaft 205. In various embodiments, the barrel support member 210 includes a plurality of cutouts 212 that are spaced (preferably at regular intervals) about the circumference of the barrel support member 210. These cutouts 212 are preferably dimensioned to provide lateral support for the barrel portions of the rifles 300 stored in the gun safe 100. In the embodiment shown in FIG. 2, these cutouts 212 are substantially oval in shape. In an alternative embodiment, the cutouts 212 may be in the form of a half-circle that is formed by the perimeter of the barrel support member 210. In various embodiments, the half-circular cutouts are adapted to substantially conform to the shape of a standard rifle barrel.

In particular embodiments, the gun support assembly 200 further includes a lower, substantially circular (e.g., substantially planar, substantially horizontal) support shelf 215 for supporting the butts of rifles 300 stored in the gun safe 100. Also, in various embodiments, the gun support assembly 200 further includes one or more upper, substantially circular (e.g., substantially planar, substantially horizontal) support shelves 220, 225, 135 that are adapted for holding items such as ammunition and/or pistols.

In a particular embodiment, at least one of these support shelves is disposed outside of the interior of the gun safe's outer housing 105. For example, in the embodiment shown in FIG. 2, the gun support assembly 200 includes an external upper shelf 135 that is disposed above and adjacent a top surface of the gun safe's outer housing 105. In this embodiment, the upper shelf 135 is spaced apart from the top surface of the outer housing 105 so that the upper shelf 135 may rotate freely without engaging the top surface of the outer housing 105. In other embodiments, the external upper shelf 135 may engage the top surface of the outer housing 105.

In various embodiments, the lower support shelf 215 and one or more upper support shelves 220, 225, 135 are mounted adjacent (e.g., on) the central shaft 205 so that the central shaft 205 extends through substantially the respective center portions of the lower support shelf 215 and the upper support shelves 220, 225, 135. Accordingly, in particular embodiments, the lower support shelf 215 and one or more upper support shelves 220, 225, 135 may rotate in a substantially symmetrical manner about the central axis of the central shaft 205. In particular embodiments, one or more of (and, in certain embodiments, all of) the lower and upper support shelves 215, 220, 225, 135 and the barrel support member 210 are all mounted to the central shaft 205 and are mounted to rotate at least substantially in tandem about the central axis of the central shaft 205. In particular embodiments, the central shaft 205 is mounted to drive one or more (and, in certain embodiments, all) of: (A) the lower support shelf 215; (B) the upper support shelves 220, 225, 135; and (C) the barrel support member 210.

It should be understood that, while the barrel support member 210, lower support shelf 215, and upper support shelves 220, 225, 135 are described herein as being substantially circular in shape, these shelves may be other shapes in alternative embodiments of the invention. For example, one or more of the shelves may be in the shape of a half circle, a square, a rectangle, or an oval.

Operation of Exemplary Gun Safe

In particular embodiments, in order to select a particular rifle from the gun safe 100, a user first unlocks and opens the gun safe's access door 120. The user then rotates the gun support assembly 200 about the central shaft 205 (either manually or via suitable controls for a motor attached to drive the central shaft 205) until the desired rifle 300 is adjacent the rectangular access passage 110. The user then removes the rifle 300 from the gun safe 100 through the rectangular access passage 110.

In particular embodiments of the invention, the gun safe 100 is adapted to allow the user to rotate the gun support assembly 200 in multiple different ways. For example, in the embodiment shown in FIG. 2, the user may rotate the gun support assembly 200 by manually exerting a rotating force (e.g., with their hand) adjacent a perimeter of any of the gun support assembly's upper shelves 220, 225, 135. Alternatively, the user may rotate the gun support assembly 200 by exerting a pushing or pulling force on one or more handles 235 that extend downwardly (or in any other suitable direction) from one or more of the gun support assembly's upper shelves 220, 225, 135.

Alternative Embodiments of the Gun Safe

In a first alternative embodiment of the gun safe, rather than including a gun barrel support member that includes exterior cutouts for supporting the barrel portions of rifles, the gun safe may include an alternative gun barrel support member 400 having a series of radial support extensions 405 that extend radially outwardly from the central shaft 403 as shown in FIGS. 6A and 6B of the provided figures. In particular embodiments, each of these radial support extensions 405 may include multiple rifle barrel support hooks 410. This allows rifles to be stored in a double-nested arrangement (e.g., two rifles per radial support extension 405), which serves to increase the gun safe's storage capacity.

In a second alternative embodiment, rather than a barrel support member that includes exterior cutouts for supporting the barrel portions of rifles, the gun safe may include a series of pistol support assemblies, each of which is configured for allowing a user to hang a pistol in a particular position within the gun safe. This may allow a large number of pistols to be stored within, and easily accessed from, the gun safe.

In particular embodiments, the gun safe's gun barrel support member and various support shelves may be manually rotated about the gun safe's central shaft. In other embodiments, the gun safe may include a motor that is adapted to selectively rotate the gun barrel support member and substantially circular support shelves about the gun safe's central shaft. In such embodiments, a user may selectively activate the motor by using, for example, a switch adjacent the gun safe's access door.

Conclusion

Many modifications and other embodiments of the invention will come to mind to one skilled in the art to which this invention pertains having the benefit of the teachings presented in the foregoing descriptions and the associated drawings. For example, as will be understood by one skilled in the relevant field in light of this disclosure, the invention may take form in a variety of different mechanical and operational configurations. Therefore, it is to be understood that the invention is not to be limited to the specific embodiments disclosed and that modifications and other embodiments are intended to be included within the scope of the appended exemplary concepts. Although specific terms are employed herein, they are used in a generic and descriptive sense only and not for the purposes of limitation.

What I claim is:

1. A gun safe comprising:

a secure housing defining an interior;

an access door that is positioned and adapted for selectively restricting access to said interior of said secure housing;

a lock that is adapted for selectively maintaining said access door in a closed and locked orientation in which said access door prevents access to said interior of said secure housing; and a rotatable gun support assembly disposed at least partially within said interior of said secure housing, said rotatable gun support assembly being adapted for rotatably supporting a plurality of rifles, wherein:

said gun support assembly comprises:

a gun barrel support member that is adapted for providing lateral support to said plurality of rifles, said gun barrel support member being disposed within said interior of said secure housing; and an external upper shelf that is disposed: (A) outside of said interior of said secure housing; and (B) adjacent an upper surface of said secure housing, and said gun barrel support member and said upper shelf are adapted to rotate in tandem in response to said rotatable gun support assembly being rotated.

2. The gun safe of claim 1, wherein said gun barrel support member and said upper shelf are adapted to rotate about a common axis in response to said rotatable gun support assembly being rotated.

3. The gun safe of claim 1, wherein said gun support assembly is adapted for supporting a plurality of rifles adjacent a perimeter of said gun barrel support member.

4. The gun safe of claim 3, wherein said gun barrel support member is substantially circular.

5. The gun safe of claim 4, wherein said gun barrel support member defines a plurality of cutouts adjacent said perimeter of said gun barrel support member, each of said plurality of cutouts being dimensioned for providing lateral support to a rifle.

6. The gun safe of claim 5, wherein said gun support assembly further comprises a lower support shelf that is adapted for supporting the butts of rifles stored in said gun safe.

7. The gun safe of claim 6, wherein said gun support assembly comprises a central shaft that is attached to drive a rotation of said gun barrel support member.

8. The gun safe of claim 7, wherein said central shaft is attached to drive a rotation of said lower support shelf.

9. The gun safe of claim 8, wherein said central shaft is attached to drive a rotation of said external upper shelf.

10. The gun safe of claim 9, wherein said central shaft extends through said upper surface of said outer housing.

11. The gun safe of claim 10, wherein said secure housing has a substantially circular cross-section.

12. The gun safe of claim 11, wherein said secure housing is in substantially the form of a cylinder.

13. The gun safe of claim 1, wherein said gun safe comprises a motor for rotating said gun support assembly.

14. A safe comprising:

a secure housing defining an interior;

an access door that is positioned and adapted for selectively restricting access to said interior of said secure housing;

a lock that is adapted for selectively maintaining said access door in a closed and locked orientation in which said access door prevents access to said interior of said secure housing; and a rotatable item support assembly disposed at least partially within said interior of said secure housing, said rotatable item support assembly being adapted for rotatably supporting a plurality of items, wherein:

said item support assembly comprises:

an item support member that is adapted for providing lateral support to said plurality of items, said item support member being disposed within said interior of said secure housing; and an external upper shelf that is disposed: (A) outside of said interior of said secure housing; and (B) adjacent an upper surface of said secure housing, and said item support member and said upper shelf are adapted to rotate in tandem in response to said rotatable gun support assembly being rotated.

15. The safe of claim 14, wherein said item support member and said upper shelf are adapted to rotate about a common axis in response to said rotatable item support assembly being rotated.

16. The safe of claim 14, wherein said safe comprises a motor for rotating said item support assembly.

* * * * *